United States Patent [19]

Scholl et al.

[11] 4,066,188

[45] Jan. 3, 1978

[54] THERMOPLASTIC ADHESIVE DISPENSER HAVING AN INTERNAL HEAT EXCHANGER

[75] Inventors: Charles H. Scholl; Larry D. Akers, both of Vermilion, Ohio

[73] Assignee: Nordson Corporation, Amherst, Ohio

[21] Appl. No.: 713,319

[22] Filed: Aug. 10, 1976

[51] Int. Cl.[2] ..... B67D 5/62

[52] U.S. Cl. ..... 222/146 HE; 165/155; 219/302; 222/504

[58] Field of Search ..... 425/378, 379; 219/230, 219/296, 299, 302, 305, 421; 165/155; 222/504, 559, 146 H, 146 HE, 488

[56] References Cited

U.S. PATENT DOCUMENTS

| | | | |
|---|---|---|---|
| 1,856,771 | 5/1932 | Loeffler | 165/155 X |
| 3,310,843 | 3/1967 | Mancuso | 222/488 UX |
| 3,570,725 | 3/1971 | Baker et al. | 222/504 |
| 3,827,604 | 8/1974 | Hamilton et al. | 222/504 X |
| 3,840,158 | 10/1974 | Baker et al. | 222/504 X |

*Primary Examiner*—Robert B. Reeves
*Assistant Examiner*—David A. Scherbel
*Attorney, Agent, or Firm*—Thomas L. Moorhead; George J. Coghill

[57] ABSTRACT

Apparatus for dispensing hot viscous liquids such as molten adhesives, either in a continuous bead or as spaced unitary deposits. In preferred form, the apparatus includes a heat exchanger in the form of a fluid manifold which functions to elevate and maintain the temperature of the molten adhesive, just prior to dispensing it, above that temperature level at which the molten adhesive is supplied to the apparatus.

6 Claims, 2 Drawing Figures

THERMOPLASTIC ADHESIVE DISPENSER HAVING AN INTERNAL HEAT EXCHANGER

BACKGROUND OF THE INVENTION

This application is an improvement upon the disclosure of application Ser. No. 565,733, filed Apr. 7, 1975 for "Molten Adhesive Dispensing Device", which application is assigned to the assignee of this application.

This invention relates to the application of liquids to surfaces and especially to equipment used to apply beads, ribbons or small unitary deposits of extruded or sprayed material in a desired pattern under high speed production conditions. More particularly, the invention relates to equipment which is particularly suitable for applying heated liquids such as "hot melt" molten adhesives to various materials such as flat sheet or webs of paper or cardboard of the type commonly used in packaging a variety of products. The invention, is equally applicable to the application of other liquid materials such as coating materials and paint which may be applied cold or at room temperature.

"Hot melt" liquids are typically of the synthetic resin type and are generally in their solid state at room temperature. When heated to molten form, they change in physical state to a relatively viscous liquid which may be pumped through the nozzle of an applicator tool or gun and applied to a surface in the form of a continuous bead or ribbon or as intermittent deposits. Normally, the molten feed stock is transmitted from solid state (e.g., pellets, bulk, billet or chunk) to molten state at a separate location by a melter structure separate from the adhesive dispenser itself. The molten feed stock is then pumped from the melter structure to the adhesive dispenser through the adhesive feed hose connected to the dispenser. Independent supply systems for melting and forwarding thermoplastic adhesive material through a feed hose to a separate adhesive dispenser or hand operated gun structure are illustrated in U.S. Pat. No. 3,964,645 for "Apparatus for Melting and Dispensing Thermoplastic Material", issued June 22, 1976 and assigned to the assignee of this application.

SUMMARY OF THE INVENTION

The main objective of the invention is to provide a novel heat exchanger located adjacent to the discharge nozzle of a molten adhesive applicator, the heat exchanger raising and maintaining the temperature of the adhesive at an elevated temperature just prior to dispensing the adhesive onto a substrate.

Another objective of the invention is to provide a heat exchanger in the form of a manifold which has a fluid flow path for the adhesive configured in such a way that the adhesive absorbs the maximum amount of heat being transferred from heaters disposed in the manifold.

Still another objective of the invention is to provide a novel heat exchanger in the form of a manifold which circumferentially encloses a valve element disposed in the central bore of the manifold. This embodiment insures that the molten adhesive immediately adjacent to the valve is maintained in a liquid state and thereby overcomes the problem of liquid adhesives cooling to the point of solidification and thereby retarding the functional operation of the applicator valve.

Other objectives and advantages of this invention will be more apparent from the following detailed description taken in conjunction with the drawings in which:

FIG. 1 is a view in vertical section of the modular hot melt applicator and air motor of this invention; and FIG. 2 is a cross-sectional view taken along line 2—2 of FIG. 1 of the drawing.

DESCRIPTION OF THE PREFERRED EMBODIMENT

Figure 1:
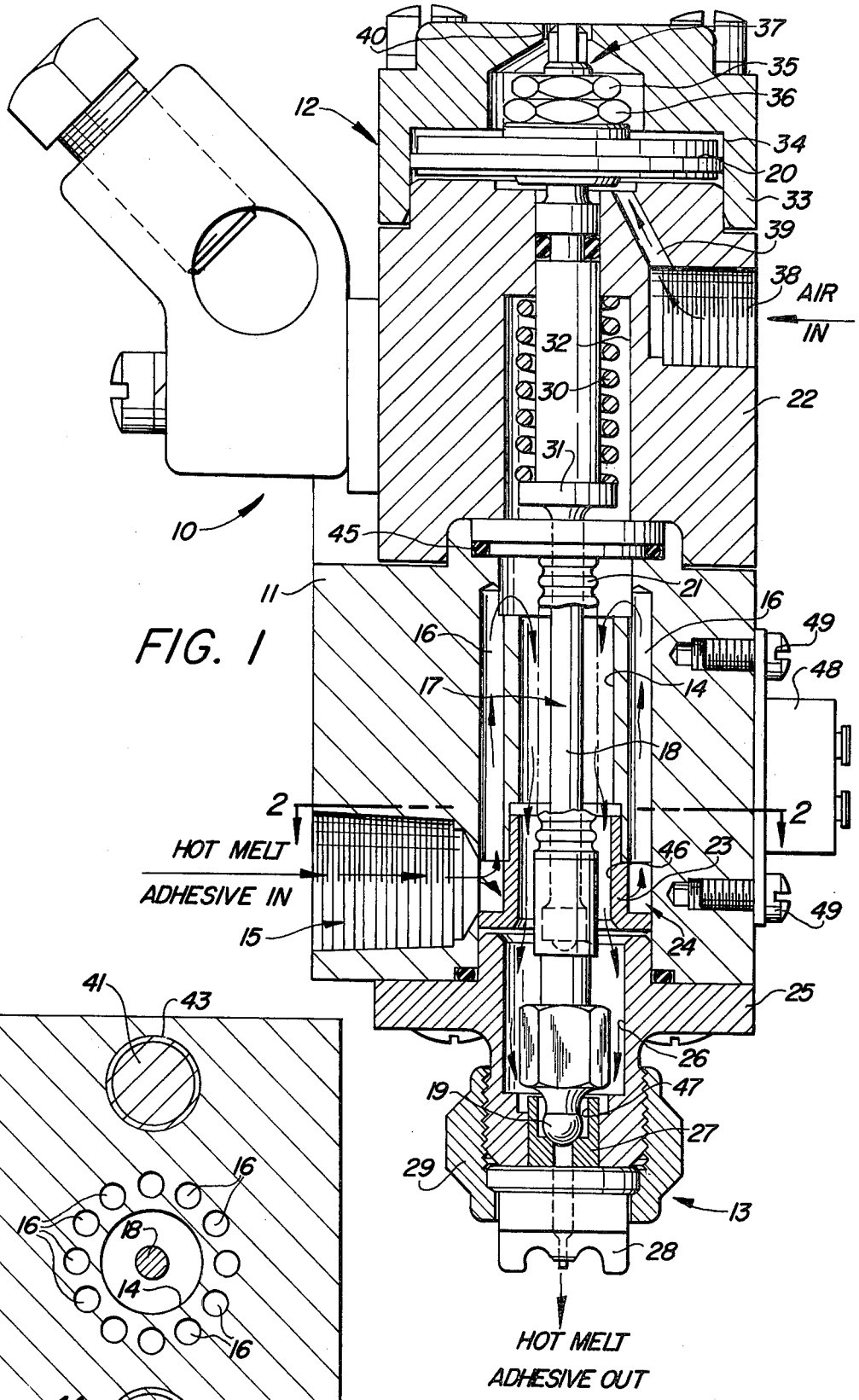
Figure 2:
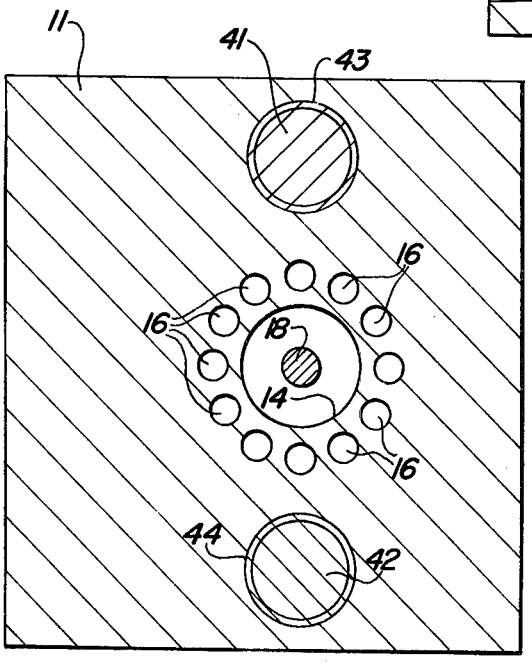

Referring to the drawings, FIGS. 1 and 2 show a modular apparatus 10 embodying the invention and adapted for use in connection with equipment for heating and circulating a hot-melt type adhesive to be applied to a substrate. The adhesive dispensing apparatus 10 comprises a body or manifold block 11 having a motor assembly 12 attached to one end thereof and an outlet nozzle assembly 13 attached to the opposite end thereof.

The body or manifold block 11 has a stepped bore 14 formed therethrough which is connected to the inlet port 15 by a plurality of parallel bores or passageways 16 formed in the manifold 11.

A valve assembly 17 extends through the stepped bore 14 and is in operative communication with the nozzle assembly 13 attached to one end of the manifold block 11. The valve assembly 17 comprises a rod 18 having a ball valve element 19 attached to one end thereof and a piston 20 attached to the opposite end of the rod 18. A bellows type seal 21 is sealingly secured to one end of the rod 18 adjacent to the valve element 19. The opposite end of the bellows seal 21 is hydraulically sealed by an "O"-ring type seal 45 and is mechanically secured between the motor block 22 of motor assembly 12 and the manifold block 11 thus sealing off the upper end of the stepped bore 14.

A sleeve 23 is pressed into sealing engagement at the opposite end of the stepped bore 14 and cooperates with the inlet port 15 to form an annular passageway 24 for conducting hot melt adhesive from the inlet port 15 through the passageway 16.

The outlet nozzle assembly 13 comprises an end plate 25 sealingly secured to the manifold body 11 by machine screws not shown. The end plate 25 is provided with a stepped bore 26 having a valve seat 27 pressed into one end thereof. An outlet nozzle 28 is sealingly secured to the end plate 25 by a threaded retaining nut 29.

The valve element 19 is biased to a closed position of engagement with the valve seat 27 by a compression spring 30 which reacts against a flanged portion 31 of the operating rod 18 and one end of a stepped bore 32 in the motor housing 22. The motor block 22 has an end cap 33 secured to one end thereof thus forming an operating chamber 34 in which the piston 20 is disposed. The piston 20 is secured to the operating rod 18 by lock nuts 35 and 36 which are in engagement with a threaded end portion 37 of rod 18. The motor block 22 and end cap 33 define an operating chamber 34 wherein piston 20 reciprocates axially in response to pressure of operating air. Operating air is transmitted to the chamber 34 through an inlet port 38 through a passageway 39 to the bottom side of piston 20. The upper side of piston 20 and chamber 34 is vented to atmosphere by means of a vent port 40 in one end of end cap 33. The operating air is conventional shop air under pressure and is operatively controlled by a valve means (not shown) to effect reciprocation of the piston 20 and valve assembly 17.

Referring to FIG. 2 of the drawings, it will be seen that the manifold block 11 is heated by two electrical resistance cartridge type heaters 41 and 42 disposed in vertical bores 43 and 44 respectively. The heaters are arranged parallel to the fluid passageways 16 and flank the stepped bore 14 in manifold block 11. The plurality of parallel bores or fluid passageways 16 are circumferentially arranged around stepped bore 14, valve 18 and are located between the heaters 41 and 42 disposed in manifold 11. The manifold 11 as disclosed herein provides a compact efficient heat exchanger which functions to elevate and maintain the temperature of the molten adhesive above the temperature level at which it is supplied to the adhesive dispenser 10.

OPERATION

In the operation of the preferred embodiment shown and described herein, the adhesive dispensing apparatus 10 is connected in a fluid circuit forming a part of a hot-melt adhesive heating and circulating system, and is positioned with its outlet nozzle assembly 13 adapted to apply adhesive to a translating surface at a desired location. An example of that type of system is illustrated in U.S. Pat. No. 3,788,561, issued Jan. 29, 1974 and assigned to the Assignee of this application. As illustrated in that patent, an adjustable timing means is provided for controlling the desired frequency of operation of the adhesive dispensing apparatus and establishes the duration of the time interval which determines the size of the unitary deposits of adhesive which are dispensed from the adhesive dispensing apparatus.

Hot-melt adhesive is pumped under pressure into the inlet port 15 of the manifold block 11 into annular passageway 24, through the parallel bores or passageway 16 to the upper end of stepped bore 14. The adhesive then flows around valve assembly 17 and downwardly through stepped bore 14, bore 46 of sleeve 23 and into bore 26 of end plate 25 and around the valve element 19 disposed in the stepped bore 47 of valve seat 27.

When the air motor assembly 12 is actuated to effect reciprocation of the valve assembly 17, the molten adhesive is dispensed through stepped bore 47 and outlet orifice 50 of nozzle 28 onto a substrate.

As the hot melt adhesive flows through the labyrinth type flow paths indicated by the arrows in FIG. 1, heat is transferred to the adhesive by the heaters which conduct heat through the manifold 11.

A thermostatic control 48 is secured to the manifold 11 by machine screws 49 and monitors the temperature of the manifold 11 and adjusts the heat output of the heaters 41 and 42 so that, the temperature of the adhesive is elevated to and maintained within a desirable temperature range.

While the invention has been shown and described with respect to a specific embodiment thereof, it will be understood that variations and modifications will be readily apparent to those skilled in the art within the intended spirit and scope of the invention. Therefore, the scope of the claims are not to be limited in any way that is inconsistent with the extent to which the progress in the art has been advanced by the invention.

Having described our invention, we claim:

1. An adhesive dispensing apparatus for extruding hot viscous liquid from a pressurized source onto a substrate surface, comprising:

a body having a central bore formed therethrough;

a passage means in said body connected to said central bore for conducting viscous liquid to said central bore;

a valve seat attached to one end of said central bore;

a movable valve assembly disposed in said central bore for operative engagement with said valve seat;

a passageway formed in said valve seat;

said valve assembly operatively controlling the flow of said viscous liquid through said passageway in said valve seat;

heater bores formed in said body adjacent to said central bore with heating means disposed therein; and a plurality of parallel bores formed in said body between said heating means and said central bore, which plurality of parallel bores are concentrically disposed around said valve assembly, and wherein the parallel bores function as heat exchanger means

2. Apparatus as defined in claim 1 wherein said parallel bores extend within said body along that portion of the valve assembly that extends within said body.

3. Apparatus as defined in claim 1 which further comprises:

a fluid inlet port connected to one end of said parallel bores;

the opposite end of said parallel bores being connected to said central bore; and a fluid outlet nozzle; wherein said body is a fluid manifold;

said fluid outlet is attached to said manifold;

said central core is connected to said fluid outlet nozzle;

said parallel bores and said central bore cooperate to form a labyrinth type flow path for said liquid; and said heating means transfers heat through said manifold into said viscous liquid.

4. Apparatus as defined in claim 1 wherein said parallel bores are uniformly spaced from each other and are disposed in uniformly spaced radial relation to said valve assembly.

5. Apparatus as defined in claim 1 wherein said body is a fluid manifold and wherein said movable valve assembly includes:

a rod and a motive means connected to said rod, said motive means being attached to one end of said manifold;

a bellows seal having one end thereof sealingly secured to said rod, the opposite end portion of said bellows seal being sealingly secured around one end of said central bore between said manifold and said motive means, and said valve assembly extending through the end of said central bore opposite the end of said central bore sealingly secured to said bellows for cooperative engagement with said valve seat.

6. Apparatus as defined in claim 1 wherein said heating means comprises:

at least two electrical resistance cartridge heaters disposed in said body substantially parallel to said parallel bores and said valve assembly and in flanking relation to said valve assembly, central bore and parallel bores.

* * * * *